United States Patent [19]

Schippers et al.

[11] 4,106,710

[45] Aug. 15, 1978

[54] WINDING MACHINES WITH CONTACT ROLLER CONTROL DEVICE

[75] Inventors: Heinz Schippers; Erich Lenk; Manfred Mayer; Hans-Jochen Busch; Hermann Bremer, all of Remscheid, Germany

[73] Assignee: Barmag Barmer Maschinenfabrik Aktiengesellschaft, Wuppertal, Germany

[21] Appl. No.: 695,784

[22] Filed: Jun. 14, 1976

[30] Foreign Application Priority Data

| | | | |
|---|---|---|---|
| Jun. 12, 1975 | [DE] | Fed. Rep. of Germany | 7518741[U] |
| Jun. 12, 1975 | [DE] | Fed. Rep. of Germany | 7518742[U] |
| Jul. 18, 1975 | [DE] | Fed. Rep. of Germany | 2532165 |
| Jul. 18, 1975 | [DE] | Fed. Rep. of Germany | 2532169 |
| Oct. 7, 1975 | [DE] | Fed. Rep. of Germany | 2544733 |

[51] Int. Cl.[2] ..... B65H 54/02; B65H 54/52; B65H 67/04

[52] U.S. Cl. ..... 242/18 R; 242/18 A; 242/18 DD

[58] Field of Search ..... 242/18 A, 18 DD, 18 R, 242/18 B

[56] References Cited

U.S. PATENT DOCUMENTS

| | | | |
|---|---|---|---|
| 2,463,773 | 3/1949 | Jencks | 242/18 R |
| 2,466,109 | 4/1949 | Jencks | 242/18 R |
| 2,972,450 | 2/1961 | Brierley | 242/18 R |
| 3,355,116 | 11/1967 | Conrad | 242/18 DD |
| 3,617,009 | 11/1971 | Lawson et al. | 242/18 R |
| 3,807,647 | 4/1974 | Miller | 242/18 DD |
| 3,861,607 | 1/1975 | Schippers et al. | 242/18 DD X |
| 3,913,852 | 10/1975 | Lenk et al. | 242/18 A |

*Primary Examiner*—Stanley N. Gilreath
*Attorney, Agent, or Firm*—Keil, Thompson & Shurtleff

[57] ABSTRACT

Winding machines having a traversing member, a contact roller, said roller or a winding tube chuck being mounted on a linearly movable carriage moved by piston-cylinder members, pneumatically operated control systems connected with said piston-cylinder members to move said carriage horizontally or vertically relative to the winding package or the contact roller, and frictionlessly operating membrane cylinder(s) mounting a support member for the carriage-mounted chuck or contact roller on the carriage, the pneumatic control system and membrane cylinder(s) maintaining constant pressure between the winding package and contact roller.

19 Claims, 15 Drawing Figures

WINDING MACHINES WITH CONTACT ROLLER CONTROL DEVICE

INTRODUCTION

With the introduction of rapid spinning and spin-drawing of synthetic fibers it has become necessary also to increase the winding machines. However by increasing the winding speeds, the noise level of the machine has also been increased. Numerous investigations have shown that the noise level is a function of the magnitude of the pressure between the contact roller and the winding package (bobbin).

A series of winding machines are known in which attempts were made to lower the pressure force between the contact roller and the package. Thus, for example, German Offenlegungsschrift No. 2,048,416 describes a device in which the pressure between the contact roller and the package is adjustable by means of a cylinder piston unit. This device, however, has the disadvantage that the pressure is applied simultaneously by the drive unit for the production of the carriage movement. Thus, irregularities in the carriage movement are reflected in the contact pressure so that it does not remain constant. In addition, the friction in the drive units has a disadvantageous effect on keeping the contact pressure constant. A further disadvantage is that irregularities in the carriage movement or in the winding package formation can lead to loads on the carriage. These must be damped because of the danger of resonant vibrations. Because of the large masses the necessary damping is complex.

The same difficulties occur in the case of winding machines with bobbin revolvers. In addition, there is the added difficulty that, during bobbin changing, the first thread layers have already formed on the empty winding tube, which layers also should not be damaged. For this reason the above mentioned German Offenlegungsschrift No. 2,048,416 also describes a device for controlling the carriage movement. The control arrangement uses cam plates and sensing devices sliding thereon. This type of control has the disadvantage that in addition to a plurality of cam plates, sensing devices and relays, there is no indication of the correctness or completeness of the movement to be carried out or which has been carried out. In addition, these cam plates are limited to very specific bobbin diameters and bobbin sizes. A further disadvantage of the control arrangement is that control commands are tripped without any guarantee of the correctness of the moment of tripping.

THE INVENTION

An object of the invention is to provide a winding machine for winding synthetic threads which permits a precisely defined contact pressure, adjustable within wide limits, to be applied between the contact roller and the packages being formed.

A "contact roller" is a roller which is in frictional contact with the bobbin (package) surface. In this arrangement it can serve as a friction roller and drive the bobbin directly or serve as a package-driven control roller which controls or measures the rotational speed of the bobbin drive.

Another object of the invention is to provide a control device for a winding machine so that any alteration of the contact pressure is immediately stabilized during the winding time without having to interrupt the winding process.

Yet another object of the invention is to design the means for applying the contact pressure so that it is transmitted without delay and without friction.

A further object of the invention is to develop a control device for use in winding machines with bobbin revolvers, which device can also be used during the thread transfer from the wound bobbin to the empty tube.

A further object of the invention is to design the above mentioned winding machine in such a way that the possible friction in the drive elements which depends on the "stick-slip" effect is reliably avoided.

An advantage of the invention is that the contact pressure between the contact roller and the bobbin or package surface is applied by a separate machine element which is used simultaneously for the production of the actual value in the control circuit and which can be adjusted independently of the drive elements of the carriage. As a result it is possible for the machine to work with extremely low pressure forces e.g., 1000 g. Even in the case of multi-level construction, i.e., with the traversing device and contact drum arranged above the winding spindle or vice versa, the contact pressure can be produced independently of the weight of the moving machine parts. Furthermore, it is advantageous that in the case of the winding machine according to the invention awkwardness or irregularities in the carriage movement or as a result of faults in the bobbin package build up are not transmitted to the carriage which carries either the bobbin or the contact roller but only to a support device having a low mass which can be easily damped. Additionally, by facilitating very low contact pressures, the danger of damage to the individual winding layers is avoided. Furthermore, as a result of these low contact pressures, profiled or textured threads can be wound without difficulty, which otherwise would be deformed by an excessively high contact pressure.

The winding machine according to the invention has moreover the advantage that the element applying and transmitting the contact pressure is able to pick up friction influences and irregularities of the carriage drive and render them technically harmless. If, contrary to expectations, the element does not do this, then it is possible to avoid them in a development of the invention in which a hydraulically acting cylinder and piston unit which acts externally on the carriage. This dampening unit requires no additional external energy source such as a pump. It is not necessary to provide a new control circuit on the winding machine since only the control elements are modified.

In order to be able to regulate or control at any time the contact pressure independently of design modifications, a membrane cylinder filled with gas and liquid is used as a force storage unit according to the invention. By a "membrane cylinder" is meant a cylinder in which no piston moves to and fro, but has a pressure chamber closed by a membrane or membranes. This membrane cylinder offers the advantage of having no sealing problems and being able to execute without friction the necessary small movements, typically of the order of 0.1 mm to 0.8 mm, required to determine the actual value described below.

In order to prevent irregularities in the roundness of the bobbin or package surface from setting up vibrations, this membrane cylinder is also provided with a damping element. The damping is achieved by the membrane cylinder being filled with oil in its lower half and with air in its upper half. Additionally, it is advantageous with membrane cylinders that they should effect an absolutely rectilinear motion so that the elements held by them require no additional rectilinear guidance. Thus, it is particularly suitable for the production of an actual value since it is certain that any magnitude of fault will immediately produce a modification of the actual value.

As the actual value is indicated very exactly and precisely, the regulator must possess the same working accuracy. Nozzles can be used as regulators in the sense of the invention, the nozzles being mounted on the carriage and at a distance from the support plate, thus forming a nozzle-impingement plate system. Contrary to expectations it has proved that the nozzle-impingement plate system is suitable in a very simple form as a highly effective working regulator. However, should the response sensitivity of this simple system not be sufficient, then it can be varied by the interconnection of suitable elements, e.g. throttles and force storage units. Control slide valves which are mechanically connected to the support device and thus can be activated in proportion to the change in the actual value can also be used as regulators.

Since the force storage unit, for example, the membrane cylinder, is constructed so as to be vibration free and friction free, the change in the distance between the nozzle and the support device can be used very well as the control value, since this responds with very great accuracy and without delay, and without unwanted response to any fault value.

The throttle for determining the desired value also has the advantage that with its use the sensitivity of the control system can be adjusted in such a way that, by exploiting the force-distance dependency of the force storage unit (for example, the membrane cylinder mentioned above), the contact pressure between the contact roller and the bobbin or winding can be adjusted. In addition, by the use of an adjustable throttle which can be controlled by a time or distance control as a function of the amount of axial movement, a constant or variable contact pressure can be achieved by simple means during winding time. The adjustment of the contact pressure is also possible if, when the force storage unit has a distance-dependent force characteristic, the nozzle is arranged so as to be axially movable in its mounting.

THE DRAWINGS

Preferred embodiments of the invention are described below in more detail with reference to the accompanying drawings, wherein.

Figure 1:
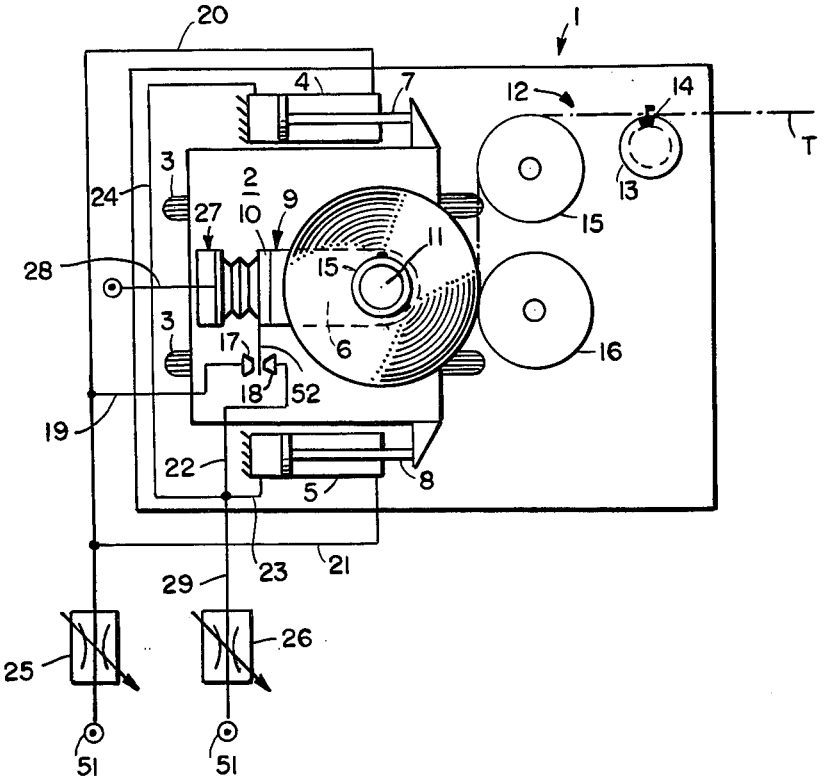
FIGS. 1 and 2 are schematic side elevations of two embodiments of winding machines according to the invention.
Figure 3:
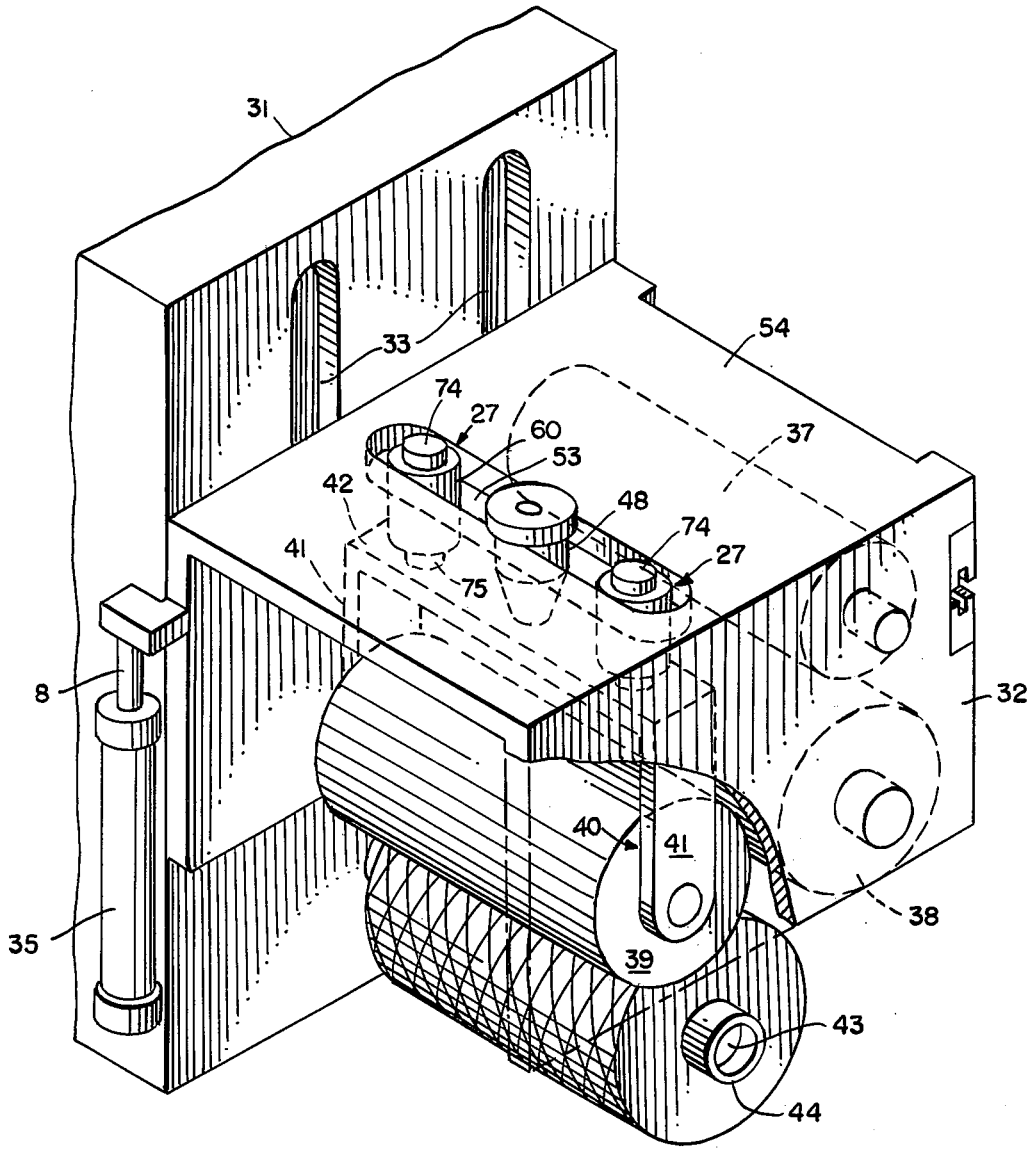
FIG. 3 is a fragmentary perspective view of the winding machine of FIG. 2 with an advantageous control device structure.

FIG. 1 shows a winding machine with a frame 1 and a carriage 2 mounted for slidable horizontal movement in guides 3. A chuck shaft 11 is mounted on a support member 9 which in turn is mounted on the carriage 2. A bobbin tube 15 is fitted on and secured to the chuck shaft 11 in known manner. The suppport member 9 comprises an arm 6 and a yoke 10. The support member 9 of FIG. 1 is like the double arm support member for the roller as shown in FIG. 3 — only one arm 6, however, being used in order that bobbin tubes 15 and wound bobbins or packages can be slipped onto and off the free end of the cantilever-mounted chuck shaft 11.

The yoke 10 is attached via a force storage unit 27 to the carriage 2. The weight of the bobbin package is borne by a slide guide (not shown) in the carriage 2, e.g., a slide guide slidably supporting arm 6 for movement parallel to the direction of carriage travel. The carriage is moved by pneumatic cylinders 4 and 5 having their cylinders mounted on the frame of the machine 1. Their piston rods 7, 8 are attached in a suitable manner to the carriage 2. In order to ensure trouble-free working of the winding machine, the pneumatic cylinders 4 and 5 are both supplied with compressed air.

A traversing device 12 is mounted in the machine frame 1, and comprises a reverse threaded shaft 13 and a thread guide 14 driven reciprocally by the shaft 13. The oncoming thread T runs over a grooved roller 15 and subtends a circumferential angle of roller surface contact of at least 60°.

The grooved roller 15 has a spiral groove (not shown) in its cylindrical surface. The running thread rides in the spiral groove and is traversed thereby in synchronization with the reciprocating guide 14 in a known manner. A friction drive roller (or a winding-driven control roller) 16 having a fixed axis of rotation is mounted in the frame 1 below the grooved traverse roller 15. The two traversing members and the drive roller 16 are driven by conventional and known mechanisms in the desired speed synchronization. See U.S. Pat. No. 3,913,852.

Two nozzles 17 and 18 are used to control the carriage movement, both nozzles being mounted on the carriage 2 adjacent the yoke 10. Nozzle 17 is connected by air pressure lines 19, 20 and 21 to the ends of cylinders 4 and 5 which project the piston rods 6 and 7. The nozzle 18 is connected by air pressure lines 22, 23 and 24 to the opposite ends of cylinder 4 and 5. The compressed air supply lines for the cylinders and nozzles each have a throttle or choke 25 and 26.

The support member 9 has its yoke 10 connected to a force storage unit, later described in detail, to provide controlled horizontal movement of the support device 9 and the package supported thereon. Compressed air for operating the force storage unit is supplied through compressed air line 28.

Figure 2:
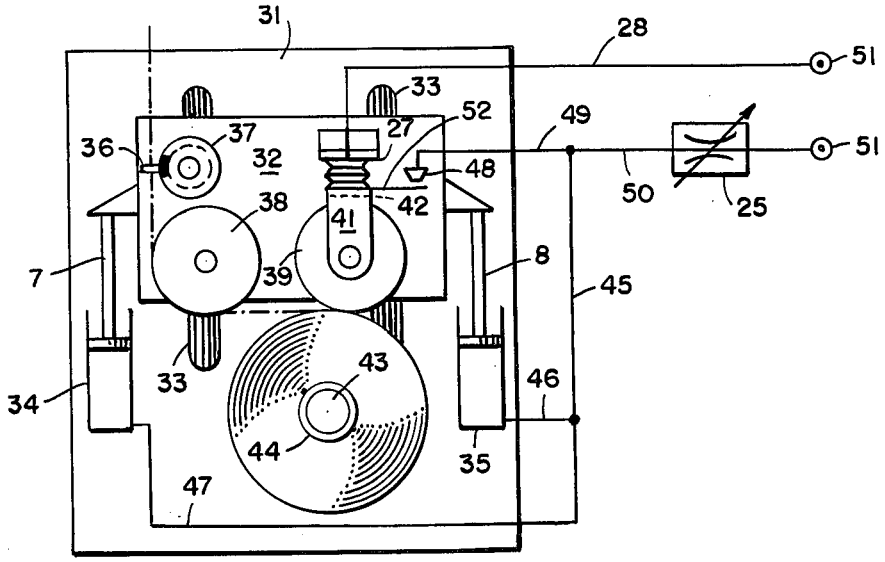

In the winding machine shown in FIG. 2, the carriage 32 is moved vertically in the guides 33 by the two pneumatic cylinders 34 and 35 mounted on the frame 31. In contrast to FIG. 1, the traversing mechanism consisting of the reciprocating thread guide 36, its reverse thread shaft 37 and the grooved roller 38, as well as the package friction drive roller 39 are mounted on the carriage. The drive roller 39 in this embodiment is supported in the support member 40 which consists of two arms 41 (c.f. FIG. 3) connected by a yoke 42. The yoke 42 is connected by the force storage unit 27 to the carriage. The chuck shaft 43 with the bobbin tube 44 is positioned below the carriage 32. Since the carriage can travel downwards under its own weight the control device can be substantially simplified in this embodiment. The pneumatic cylinders 34 and 35 are therefore single-acting pressure cylinders supplied with pressure at their lower ends only by compressed air lines 45-47. The nozzle 48 is connected by compressed air line 49 in the compressed air system parallel to the pressure chamber of the cylinders. The throttle 25 is positioned between the cylinders and a pressure medium reservoir 51 in the supply line 50.

The force storage unit 27 in FIG. 2 is adapted to move the drive roller 39 vertically to a limited degree relative to the carriage 32. As described hereinafter, the nozzles 17, 18 (FIG. 1) and the nozzle 48 (FIG. 2) coact with a compressed air impingement surface or surfaces, e.g., the impingement plates 52 projecting from yoke 10 and yoke 42, respectively.

FIG. 3 is a perspective view of the winding machine shown schematically in FIG. 2, showing more clearly the way in which the support device is mounted in the carriage 32. The yoke 42 is mounted in the carriage 32 by two force storage units 27 which extend through and are fixedly mounted in the slot 53 in the top plate 54 of the carriage 32.

In the embodiment of FIG. 3, the impingement surface for compressed air issuing from the nozzle 48 (shown schematically in FIG. 2 as the plate 52) is the top surface of the yoke 42. The nozzle 48 is mounted fixedly or adjustably in the slot 53 between the two force storage units 27. The distance between the nozzles 17, 18 and 48 and the plate 52 or yoke 42 (FIG. 3) is very small whereby a small movement of the plate or yoke materially changes the back pressure on the air exiting from the nozzle. The effects of such changes are discussed below.

Figure 4:
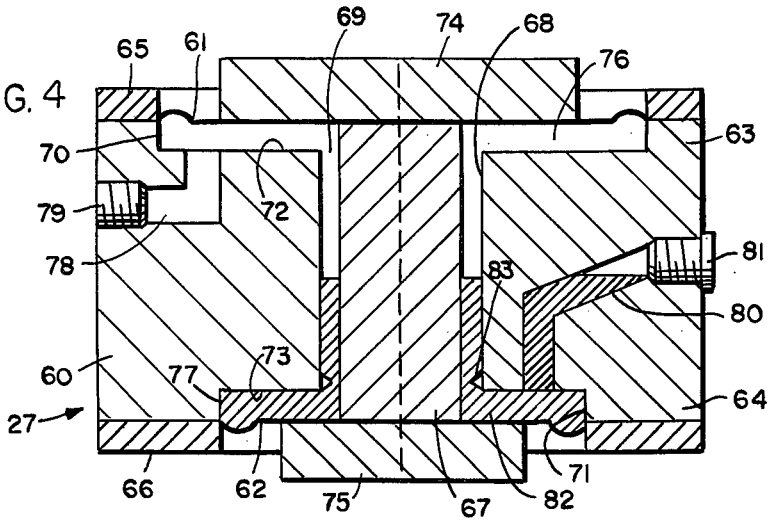
FIG. 4 is a diametric cross section of a membrane cylinder which can be used in the invention.

FIG. 4 shows a section through the force storage unit 27 used in the invention. The force storage unit 27 comprises a cylindrical body 60 with an upper membrane disc 61 and a lower membrane disc 62 smaller in pressure-exposed area than the membrane 61. The two membranes 61 and 62 are clamped about their peripheries on the raised annular shoulders 63 and 64 of the body 60 by means of clamping rings 65 and 66. A cylindrical member 67 is loosely positioned in an axial bore 68 in the cylindrical body 60, its diameter being slightly smaller than the diameter of the bore. An annular gap 69 is thus defined between the member 67 and bore 68.

The end faces of the cylindrical member comprise coaxial cylindrical recesses 70 and 71 defined by ring walls 72 and 73 and the inside walls of the annular shoulders 63 and 64. These recesses provide annular chambers 76 and 77 beneath each membrane, which chambers are connected by the annular gap 69.

The center portion of each membrane 61 and 62 is covered by a rigid disc 74 and 75. These discs are fixedly attached to respective opposite ends of the cylindrical member 67, with the central parts of the membrane clamped therebetween. The members 67, 74, and 75 are movable axially relative to the cylindrical body within limits — their position being determined by the relative difference in total pressure force exerted on membrane 61 vs membrane 62.

The total pressure-force-exposed area of membrane 61, which with disc 74 forms the movable annular wall of chamber 76, is greater than that of membrane 62, which with disc 75 forms the movable wall of chamber 77.

A compressed air passage 78 in the body 60 having a tapped inlet 79 for connecting a coupling of the compressed air line 28 communicates with the chamber 76. The other chamber 77 communicates with another passage 80 in the body 60, the outlet end of which passage is closed by the threaded plug 81.

The force storage unit 27 is about half-filled with oil 82 through the passage 80. Preferably, the oil filled portion has a throttle or choke structure, which in the illustrated embodiment is provided by the narrower gap between the cylindrical member 67 and the ring 83 on the lower end of the axial bore 68. The resulting throttle or choke gap thereby is always immersed in oil. The lower disc 75 of each force storage unit 27 is fixedly attached to yoke 42.

The operation of the aforesaid embodiments will now be described in more detail. Only the elements necessary for an understanding of the control system have been illustrated in the FIGS. 1 - 3, and other elements which are usual or necessary for safe winding but which are conventional in the case of winding machines have been omitted.

When starting up the winding machine, the force storage unit 27 is supplied with compressed air at working pressure, usually 6 bars, through the inlet bore 78. Depending on the value of the pressure force area difference between the membranes 61 and 62, a predetermined holding force is produced by the unit 27. This holding force can be varied by interposing an adjustable pressure reducing element in the line 28. The pressure in the force storage unit 27 is adjusted in such a way that the weight of the support member 41, 42 and the contact roller supported therein (FIGS. 2 and 3) is largely compensated. In FIG. 1 the pressure is adjusted so that the desired pressure is present between the contact roller and the bobbin package — the oil 82 in the unit also being eliminated.

If the winding machine shown in FIG. 1 is constructed in such a way that the carriage 2 moves vertically, a control device must be interposed in the supply line to the force storage unit 27 so that a constant residual force is always present to cause the bobbin to exert pressure on the contact roller. The control device can for example be in the form of a template, a control valve then being associated with the carriage, which valve scans the template attached to the machine frame.

If the bobbin package grows in diameter in the case of the winding machine shown in FIGS. 2 and 3, the contact roller and the support device move out of their working position. Here the force storage unit 27 shown in FIGS. 2 and 3 behaves as follows. The two membranes 61 and 62 curve upwards, as a result of which the oil 82 in the lower chamber 77 is pressed through the throttle gap at 83. This produces a slight damping effect and avoids the setting up of oscillations in the system.

At the same time the gap between the nozzle 48 and the yoke 42 becomes smaller, so that the quantity of air flowing out of the nozzle also becomes smaller. As a result almost all of the air flowing through the throttle 25 is now supplied to the pneumatic cylinders 34 and 35. The carriage therefore moves upwards. As a result the support device 41, 42 with its weight and that of roller 19 supported by the force storage units 27, drops down again by the distance covered by the upward carriage movement and the gap between the nozzle 48 and the yoke 42 becomes greater again. The carriage remains stationary once the working gap has been reached again between the nozzle and the yoke. When the support device moves down into its working position the deflection of the membranes is reversed and the oil is pushed back through the throttle by the air pressure prevailing in the annular space 76. A reverse sequence occurs when the support device is moved downwards past its working position.

In FIG. 1, as the bobbin package diameter increases, so does the gap between the nozzle 18 and the support device 9, while the gap between the nozzle 17 and the support device 9 is reduced. In this way the pneumatic cylinders 4 and 5 are supplied with compressed air in such a way that the carriage moves to the left. When the carriage moves, the air on the left-hand side of the pistons in the cylinders 4 and 5 can flow out at the nozzle 18. As a result of the carriage movement, the working gap readjusts itself between the nozzle 18 and the plate 52 on the one hand and the nozzle 17 and the plate 52 on the other hand until pressure equilibrium is reached and the carriage comes to a standstill.

By incorporating an adjustable throttle or choke 25, 26 in the common supply line 20, 29 or 49 to the nozzle 17, 18 or 48 and the pneumatic cylinders 4 and 5, the response sensitivity of the system can be adjusted. If an adjustable pressure reducing is incorporated in the supply line 28 to the unit 27, the pressure holding force applied by the unit 27 can be varied during the operation of the winding machine. A further way of adjusting the holding force is to mount the nozzles 17, 18 or 48 by adjustable means whereby their distance from the impingement plate 52 or yoke 42 can be varied. For any given gap between the respective nozzles and the impingement plate or yoke, the carriage adjusts itself so that it has a corresponding equilibrium position. In this way the relative position of the contact roller 16 or 39 can be adjusted in relation to the carriage, which position is then stabilized during the diameter increase of the bobbin by coaction of the nozzle(s) and yoke or plate. It is also possible to bring about a change of the pressure between the bobbin and the package being formed by adjusting the throttle or choke. The changing of the holding force during the winding operation has already been described above.

As has been shown by exhaustive tests, oscillations induced during winding on the bobbin or contact roller and their respective support members 9 or 41, 42, are immediately damped by the force storage units used in the invention. Because of the way in which movement of the carriage is controlled, sudden changes in load have no long lasting or significant influence on the movement of the carriage so that a constant pressure between the winding and the contact roller is ensured.

Figure 5:
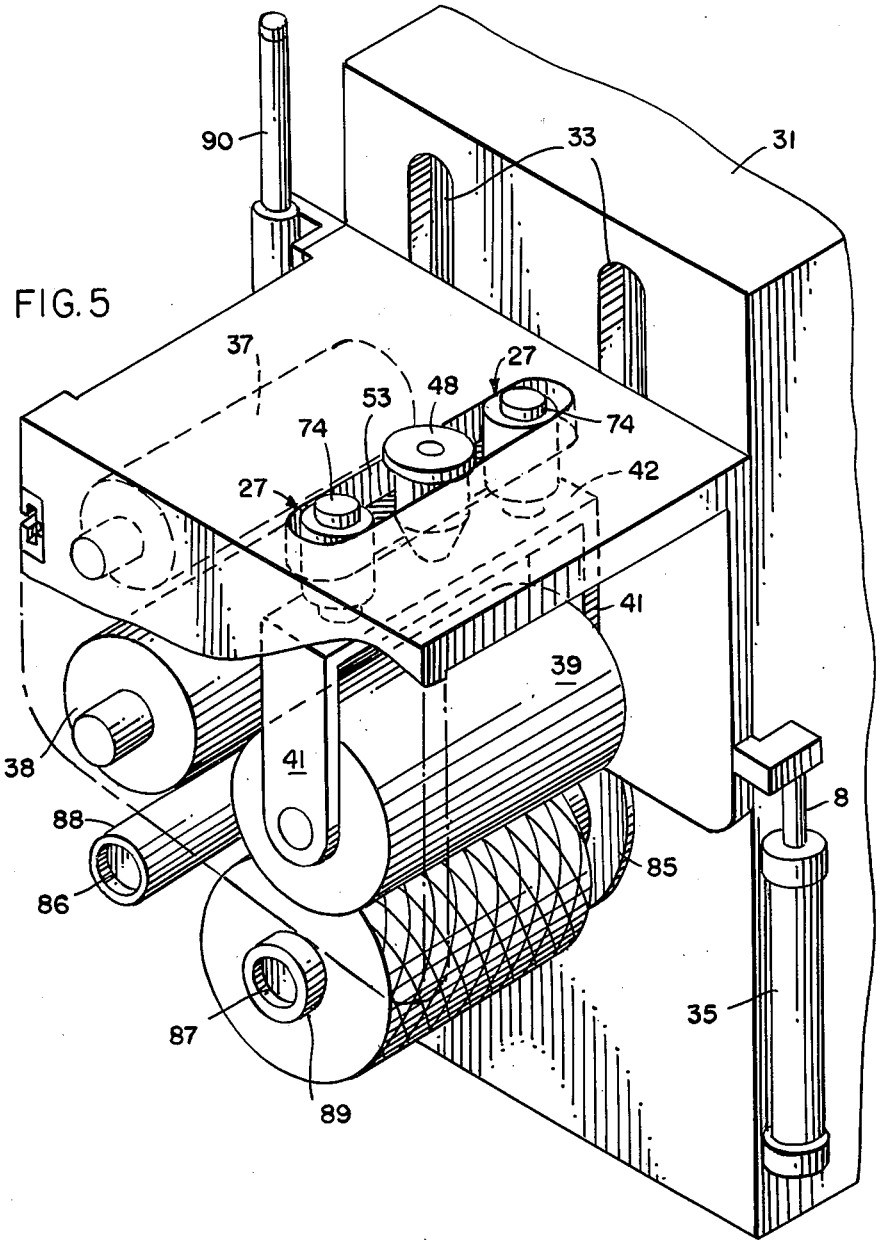
FIG. 5 is a perspective view, partly broken away, of a winding machine with a bobbin revolver and control device.

FIG. 5 shows a winding machine which is similar to that of FIGS. 2 and 3 except that a bobbin revolver is provided on which two chuck shafts 86 and 87 are mounted, each shaft having a winding tube 88 and 89 respectively. Additionally, a thread transfer device 90 is provided on the machine. For further details, reference is made to U.S. Pat. No. 3,913,852.

Figure 6:
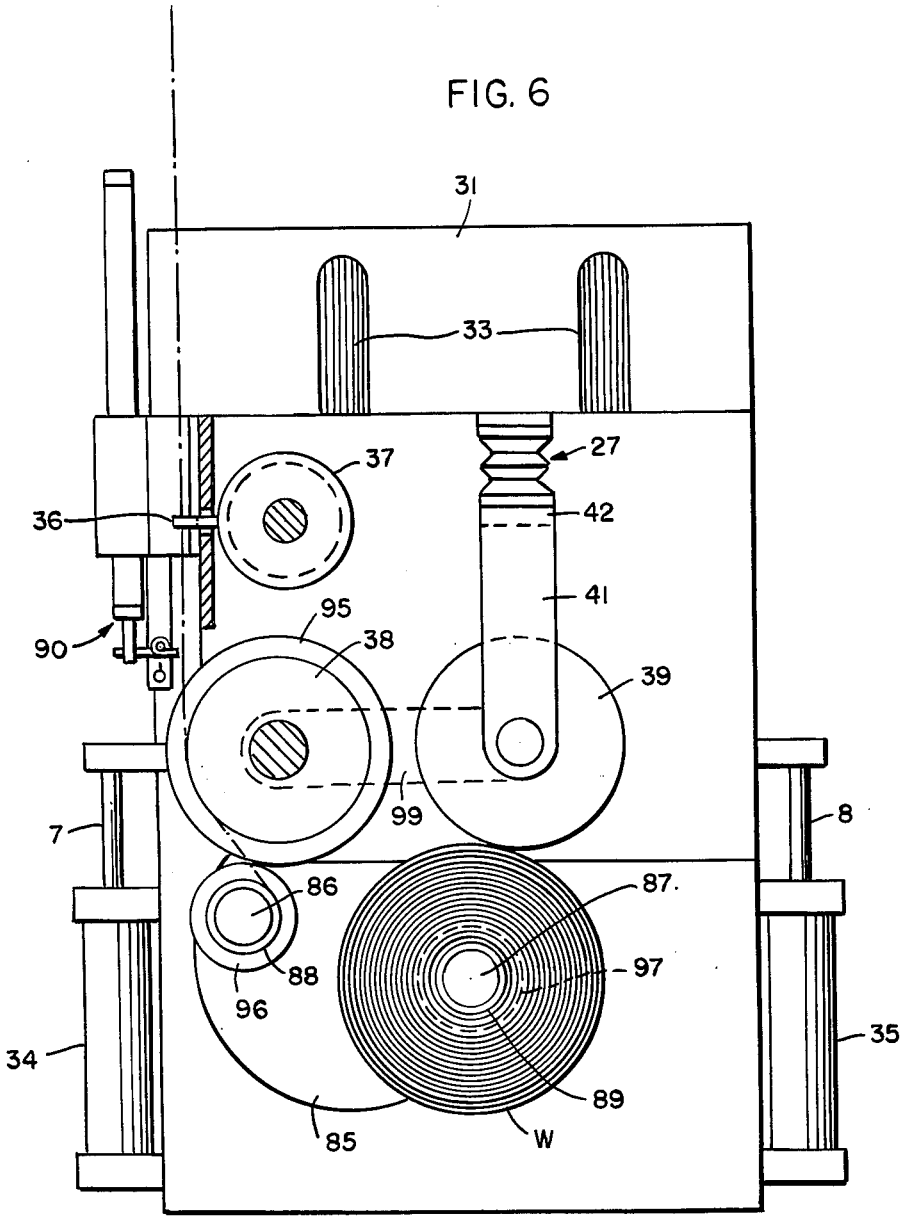
FIG. 6 is a cross section just behind the outer vertical well of the carriage.

The winding machine of FIGS. 5 and 6 has a control device which works alternately with two regulators whose significance is explained further below. The regulator comprises discs 95, 96 and 97. These discs are designed as electrical contacts. The disc 95 is mounted coaxially with the axis of the grooved traversing roller 38. The other two discs 96 and 97 are mounted on the chuck shafts 86 and 87, respectively, all three discs being in coplanar alignment with one another. All three discs are electrically insulated from the machine frame 31 and the bobbin revolver 85. The diameter of the disc 95 is greater than the diameter of the grooved roller 38. In addition, the diameters of the discs 96 and 97 are slightly greater than the diameter of the winding tubes 88 and 89.

At high winding speeds, in order to avoid backing-off, it may prove necessary to keep constant the length of thread between the point at which the thread leaves the grooved traversing roller 38 and the point at which the thread runs on to the bobbin winding. For this reason, as indicated in FIG. 6 by a broken line member 99, both the contact roller 39 and the grooved roller 38 are supported in the movable support device 41, 42 so that they move up and down together.

Figure 7:
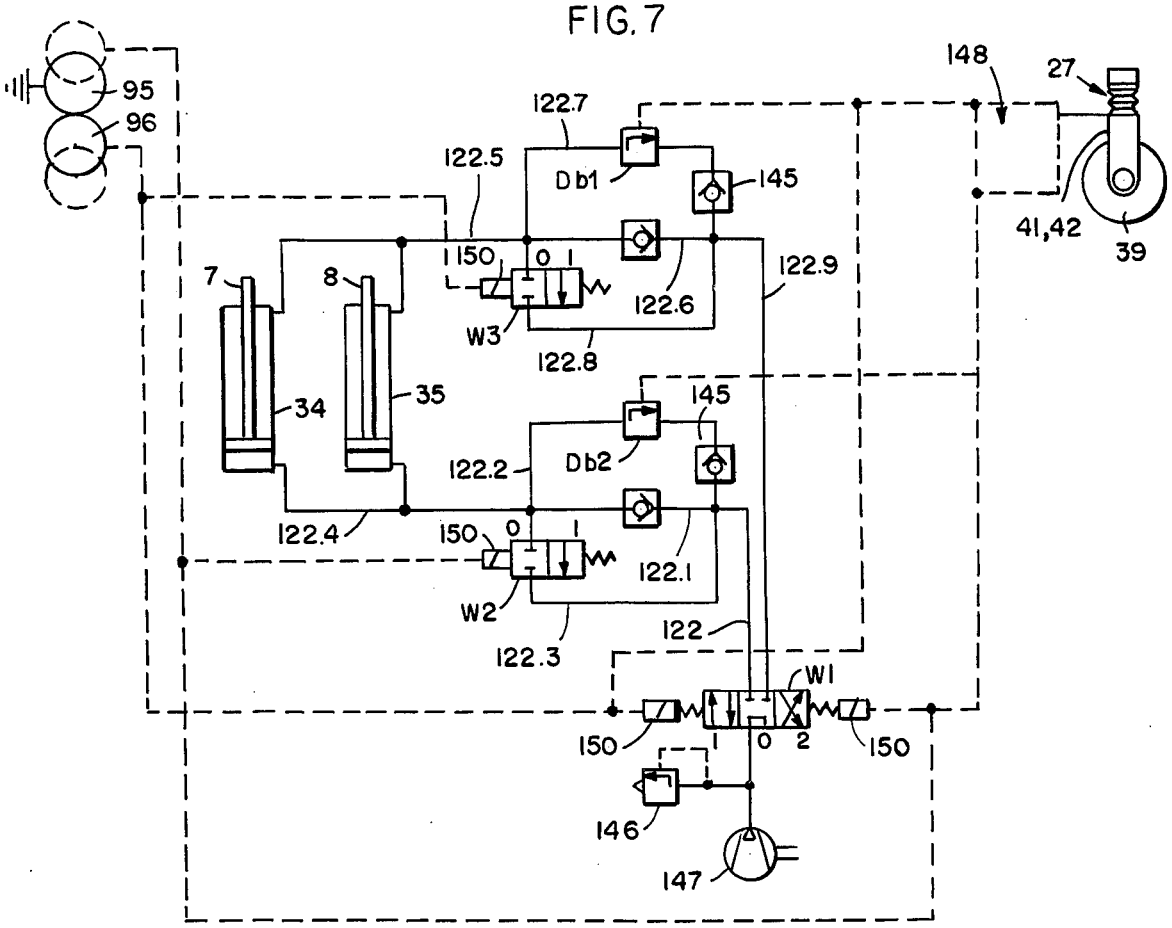
FIG. 7 is a schematic diagram of an electro-pneumatic circuit for controlling carriage movement according to the invention.
Figure 15:
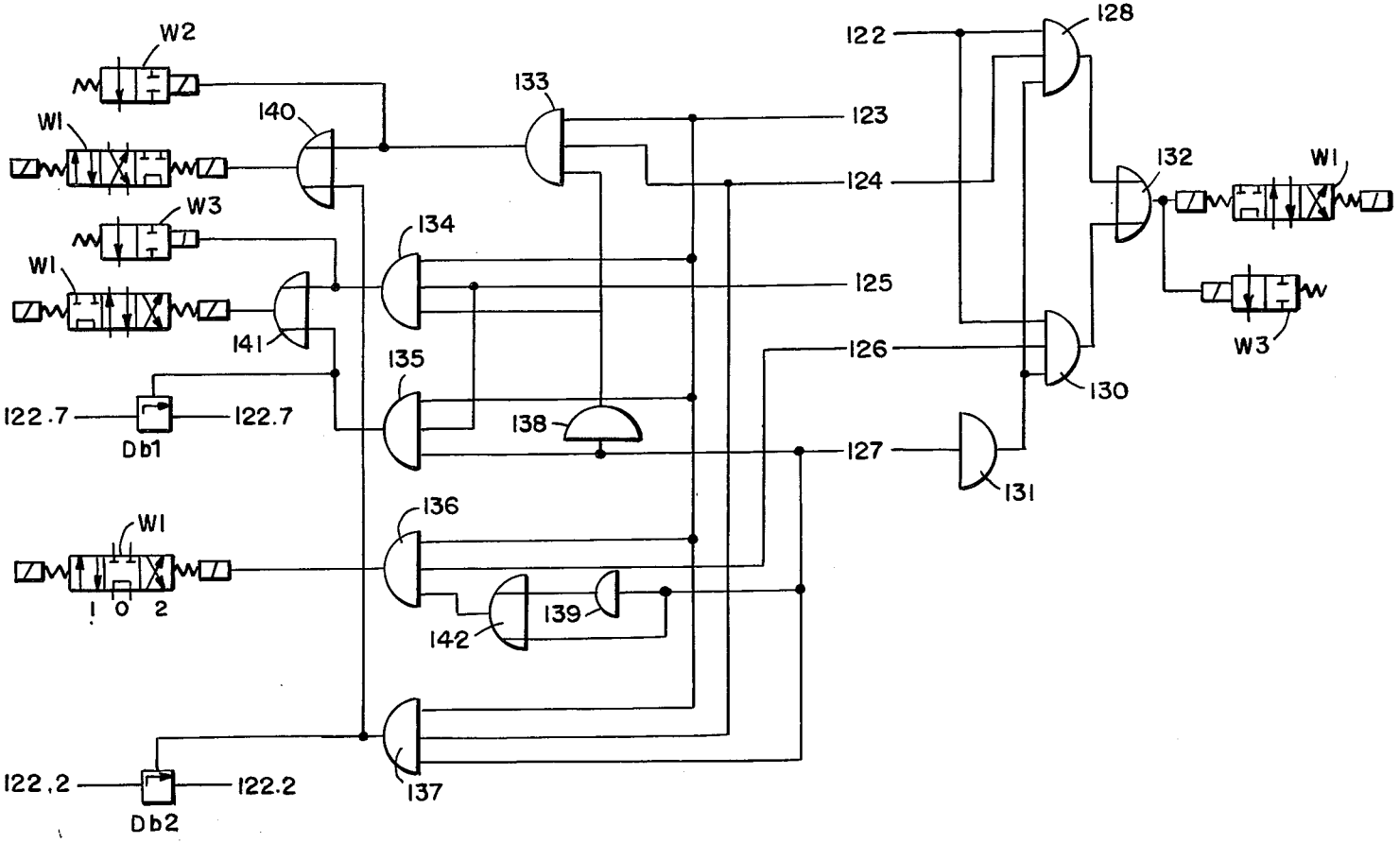
FIG. 15 is a schematic view of a pneumatic control system with its respective functional elements.

The operation of the control device used in FIG. 6 for controlling carriage movement will now be illustrated in greater detail with reference to the schematic circuit diagram shown in FIGS. 7 and 15. The diagram shows only the elements necessary to understand the invention. Reference should also be made to the working positions of the bobbin revolver shown in FIGS. 9 to 12.

Figure 9:
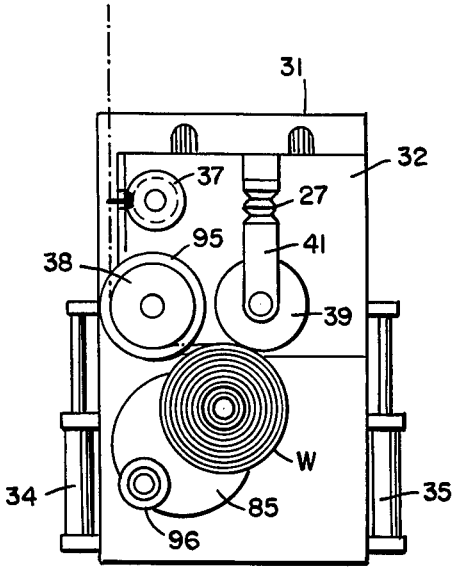
FIGS. 9 to 12 are side elevations of four working positions of the bobbin revolver of the winding machine shown in FIG. 5.

FIG. 9 shows the bobbin revolver 85 in its working position. It is stopped by stopping means (not shown) in known manner in this position (not shown), and a signal emitted by this stopping is designated in FIG. 15 by the numeral 127. With increasing bobbin diameter, the carriage 32 must be moved vertically upwards. This movement takes place under the control of the support device 41, 42 which is mounted in such a way as to be movable relative to the carriage. The growth of the winding W deflects the support device upwards via the contact roller 39. As a result a signal 125 (see FIG. 15) is emitted. As the axial discs 95 and 96 or 97 are not in contact with one another a signal 123 is also emitted. When these three signals 127, 125, 123 are present, a signal appears at the output of the AND gate 135 which switches a valve Db1 and, via the OR gate 141, switches a valve W1 into position "1". As a result, pressure medium, generally compressed air, passes from a pressure medium source (e.g., a pump) or from a storage container (not shown) via pipes 122, 122.1 and 122.4 into the pneumatic cylinders 34 and 35 (FIG. 7). The pistons and their rods in the pneumatic cylinders are thus moved out. Flow of pressure medium out of the pneumatic cylinders 34 and 35 is regulated by the position of the support device 41, 42 via the valve D*b*1, which is incorporated in a pipe 122.7 connected via a pipe 122.5 to the pneumatic cylinders and via a pipe 122.9 to the valve W1. By the upward movement of the carriage 32, thus produced, the contact roller 39 is again lowered into its working position and the valve D*b*1 is closed. The carriage 32 thus comes to a standstill. As a result, the signal 125 ceases and a signal 126 is emitted. This causes a signal to appear at the output of the AND gate 136 which switches the valve W1 into the "0" position.

If, because of some fault, the carriage 32 moves too far upwards, the support device 41, 42 after passing its working position is moved downwards. This causes the emission of a signal 124 which is applied to one input of the AND gate 137. As a result a signal appears at the output of the gate 137 which switches the valve Db2 and, via the OR gate 140, switches the valve W1 into position "2". Valves D*b*1, D*b*2 are like throttles which regulate continously the flow-through of the compressed air from 0 to maximum. As a result the direction of movement of the carriage 32 is reversed. The compressed air now passes via the pipes 122.9, 122.6 and 122.5 into the upper part of the pneumatic cylinder (FIG. 7). The outflow is regulated as a function of the particular position of the support device 41, 42 by the valve D*b*2, and the compressed air flows back through the pipe 122.4, 122.2 and 122 to the valve W1. The carriage 32 moves downwards until the support device 41, 42 is back in its working position. In so doing the signal 124 ceases and the signal 126 is again present so that the AND gate 136 switches the valve W1 into position "0". The carriage 32 therefore comes to a standstill.

Once the winding *w* on the tube 89 has reached its predetermined size, the bobbin change process is initiated via suitable sensing devices. To do this, means stopping movement of the bobbin revolver 85 are first of all released. As a result the signal 127 ceases and a signal is therefore present at the output of the NOT gate 138 and 131.

A rotational moment is exerted by the full bobbin W on the drive of the bobbin revolver 85 which tends to cause the full bobbin to rotate suddenly downwards. In order to prevent such sudden rotational movement of the bobbin revolver 85, a braking moment is applied to the motor provided to drive the bobbin revolver 85. As a result the bobbin revolver rotates slowly.

Simultaneously with the release of the stopping means of the bobbin revolver, the bobbin tube 88 is accelerated by drive applied to the axis thereof to the required circumferential speed. The support device 41, 42 is moved downwards out of its working position by the rotation of the bobbin revolver. The signal 124 is emitted and, as the axial discs 95 and 96 are still not in contact, the signal 123 continues to be emitted. Thus a signal appears at the output of the AND gate 133 so that the valve W1 is switched into position "2" via the OR gate 140, and the valve W2 is switched into position "1". The rate of flow through the valve W2 or W3 is chosen to be such that the carriage 32 can follow the rotational movement of the bobbin revolver 85 and is not too fast. Thus the carriage 32 follows the downwards movement of the full bobbin W by the pneumatic cylinders 34 and 35 being supplied with compressed air via the pipes 122.9, 122.6 and 122.5. Air flowing out of pneumatic cylinders passes out via the pipes 122.4, 122.3 and 122.

Figure 10:
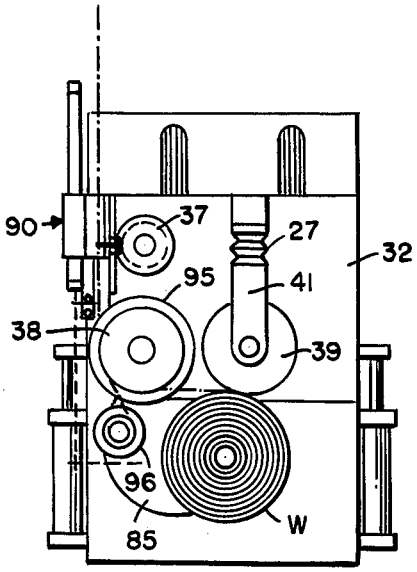

The bobbin revolver 85 rotates until it reaches the position shown in FIG. 10. At this point the AND gate 136 receives signals 123 and 126. A signal therefore appears at the output of the AND gate 136 which switches the valve W1 into position "0". This causes both the bobbin revolver and the carriage to be stopped. In this position the thread is transferred by the thread transfer device 90 from the full bobbin W to the empty tube 88. After the thread transfer the bobbin revolver continues to rotate. As a result the axial spacing discs 95 and 96 come into contact while at the same time the support device 41, 42 is moved downwards again out of its working position.

The signal 123 now ceases and the signal 122 and the signal 124 and the inverted signal 127 are emitted. Consequently the signal 123 is missing from the AND gates 133, 134, 135, 136 and 137, so that the carriage control can only be operated via the AND gates 128 and 130.

When the signals 122, 124 and the signal 127 inverted by the NOT gate 131 are present, a signal is present at the output of the AND gate 128, and as a result the valve W1 and the valve W3 are switched into position "1" via the OR gate 132. As a result the pneumatic cylinders 34 and 35 are provided with compressed air via the pipes 122, 122.1 and 122.4, which leaves the cylinders via the pipes 122.5, 122.8 and 122.9. The carriage 32 travels vertically upwards until the discs 95 and 96 move out of contact. At the same time the bobbin revolver 21 rotates further. The support device 41, 42 is moved completely downwards.

Figure 11:
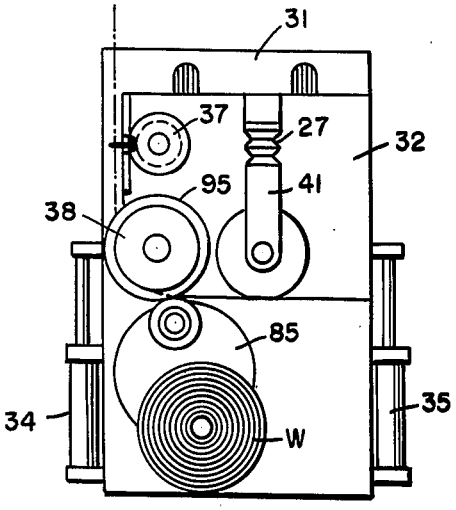

FIG. 11 shows a position in which the carriage 32 must reverse its direction of movement. As long as the spacing discs 95 and 96 are in contact, the carriage 32 travels upwards. As a result of the continued rotation of the bobbin revolver past the position shown in FIG. 11, the spacing discs 95 and 96 cease to be in contact. Thus in FIG. 15 the signal 122 ceases and the signal 123 reappears. Since now the signal 123, the signal 124 and the signal 127 inverted by the NOT gate 138 are all present at the inputs of the AND gate 133, a signal appears at the output thereof which causes the valve W2 to be switched into position "1" and via the OR gate 140 the valve W1 to be switched into position "2". The carriage 32 moves downwards as the pneumatic cylinders 34 and 35 are supplied with compressed air via the pipes 122.9, 122.6 and 122.5. The air flowing out of the pneumatic cylinders passes out via the pipes 122.4, 122.3 and 122. As the bobbin revolver rotates continuously and the carriage 32 cannot change its direction of movement suddenly, there is a slight delay before the carriage 32 follows the rotation of the bobbin revolver 85 and moves downwards. As a result the spacing discs 95 and 96 remain out of contact with one another.

Figure 12:
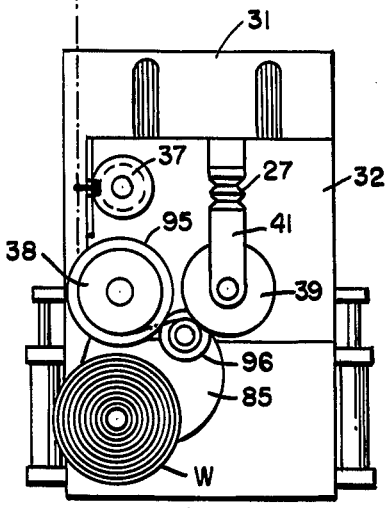

The rotational speed of the bobbin revolver and the downward movement of the carriage are adapted to one another in such a way that, in the working position shown in FIG. 12, the support device 41, 42 is raised back into its working position via the contact roller 39. At the same time the spacing discs 95 and 96 again come into contact. The signals 122, 126 and the inversion of the signal 127 are thus present as the inputs of the AND gate 130 which thereby switches the valve W1 and the valve W3 into position "1" via the OR gate 132. The carriage 32 moves vertically upwards as the pneumatic cylinders 34 and 35 are supplied with compressed air via the pipes 122, 122.1 and 122.4, the air exiting via the pipes 122.5, 122.8 and 122.9.

However, the carriage 32 moves only slightly, since with rotation of the bobbin revolver or with upward movement of the carriage, the spacing discs 95 and 96 are again immediately disengaged. Consequently the signal 122 ceases and the signal 123 reappears. However since the bobbin revolver is rotated further into its working position, the support device 41, 42 is displaced upwards. As a result the signals 123, 125 and the inversion of the signal 127 are supplied to the inputs of the AND gate 134 so that it switches the valve W3 and via the OR gate 141, switches the valve W1 into position "1". The pneumatic cylinders 34 and 35 are supplied with compressed air via the pipes 122, 122.1 and 122.4 which leaves them via the pipes 122.5, 122.8 and 122.9.

The support device 41, 42 is lowered into its working position by the upward movement of the carriage 32 and the signal 125 ceases. As the bobbin revolver 85 in the meantime has reached its working position (FIG. 9), it is stopped. As a result, the signal 127 is emitted and a signal therefore applied to the AND gate 136 to cause the carriage 32 to stop. The above described operational cycle can then start again. The dotted lines in FIG. 7 designate electrical circuits which connect discs 95, 96 (or 95, 97) with solenoids 150 of valves W1, W2 and W3.

Symbols in the flow diagram designating conventional parts include one way or check valves 145, constant pressure regulating units 146, and compressed air pumps or reservoirs 147. The broken lines in FIGS. 7 and 8 symbolize electric and electropneumatic circuits which operatively connect the spacer discs 95, and 96, valve solenoids 150, throttle-like valves Db1, Db2 and a sensor unit 148 which monitors the relative positions of the contact roller support device 41, 42.

The spacer disc 95 is mounted coaxially with the spirally grooved traversing roller 38, and the additional spacer discs 96, 97 are mounted coaxially with each respective chuck 86, 87. The spacer discs lie in a common vertical plane whereby, during the bobbin changing step by revolving the bobbin revolver through the cycle illustrated in FIGS. 9-12, the distance between the empty tube surface and said spirally grooved traversing roller surface is kept constant by edge-to-edge contact of disc 95 with a respective disc 96 or 97.

The full bobbin W is removed from the chuck shaft 87 and a new empty tube is substituted.

Figure 8:
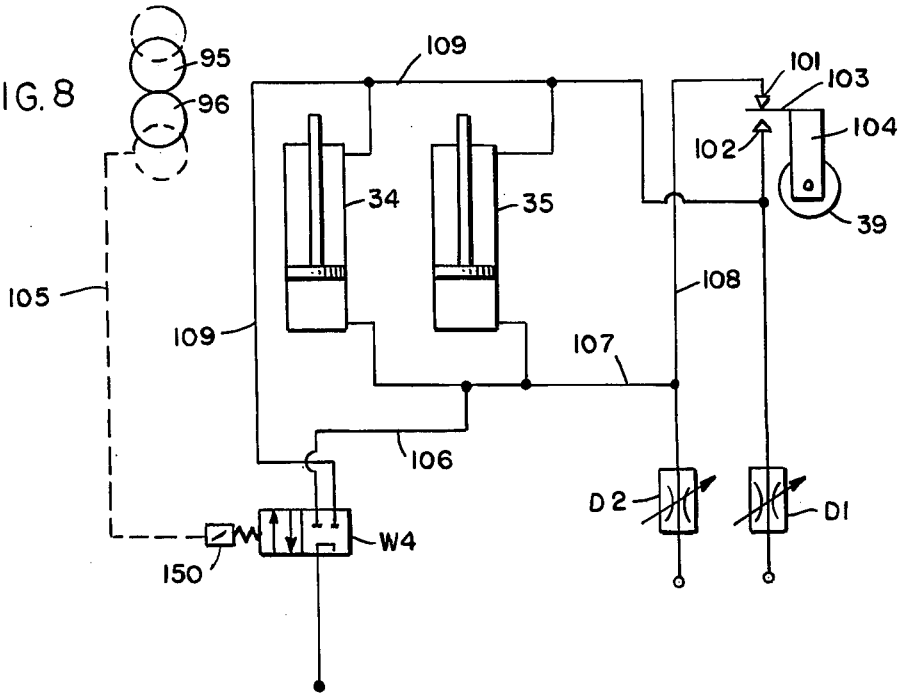
FIG. 8 is a diagram of another circuit for controlling carriage movement of the winding machine shown in FIG. 5, using a pneumatic nozzle and impingement plate.

FIG. 8 shows a different control device for the controlling movement of the carriage. In contrast to the device shown in FIG. 7 it comprises two nozzles 101 and 102 which coact with the nozzle-impingement plate 103 on the yoke 104. The complexity of switching is substantially simplified. During the winding process the control system works in a similar manner to that described in FIG. 1, as the valve W4 is switched into the illustrated blocking position.

During the bobbin-changeover, the switching sequence is as follows. As a result of the rotation of the bobbin revolver 85, the distance between the nozzle 101 and the plate 103 increases. Thus the air can escape from the undersides of the pistons in the cylinders 34 and 35, allowing the carriage 32 to move downwards. With the continued rotation of the bobbin revolver, the spacing discs 95 and 96 come into contact with one another. As a result the valve W4 is switched via circuit 105 to its on position. Thus compressed air then flows via the pipe 106 into the pipe 107. As a result, the pistons in the pneumatic cylinders 34 and 35 move upwardly. The gap between the nozzle 101 and the yoke plate is not of any significance, since air is admitted into the system both via the throttle D2 and the pipe 108 and also through the valve W4, the pipe 106 and the pipe 107. As the carriage moves upwards air expelled from above the pistons in the cylinders 34 and 35 escapes via the pipe 109 and the valve W4.

If the spacing discs 95 and 96 move out of contact, the valve W4 is switched back into the blocking position. This prevents any more air from being introduced via the pipe 106 into the operating system and the air flowing in through the throttle D2 and the pipe 108 can flow away at the nozzle 101. At the same time air flows out of the chambers below the pistons in the cylinders 34 and 35 via the pipes 107 and 108 and thence out of the nozzle 101. The carriage 32 therefrom moves downwards again.

As has been confirmed by exhaustive tests, this very simply but reliably constructed pneumatic circuit is quite adequate to carry out safely all operational sequences occurring during winding and bobbin change.

Instead of using two nozzles 101 and 102 it is possible instead to use only one nozzle 101. During winding this control device then operates like that described with reference to FIGS. 2 and 3. During bobbin changing the device then works as described above. However, in this case the carriage 32, which moves downwards under its own weight, may move downwards too slowly in relation to the rotational speed of the bobbin revolver 85. In this case the circuit shown in FIG. 7 or 8 is preferable.

Figure 14:
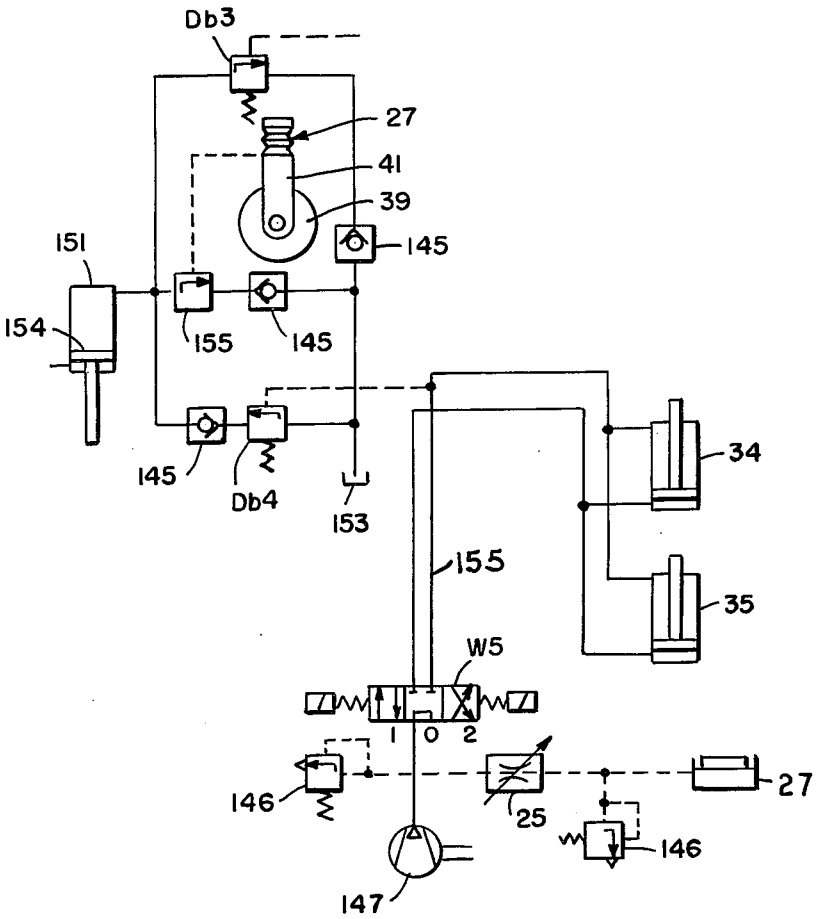
FIG. 14 is a schematic circuit diagram of a control system for a hydraulic cylinder used in the machine of FIG. 13.
Figure 13:
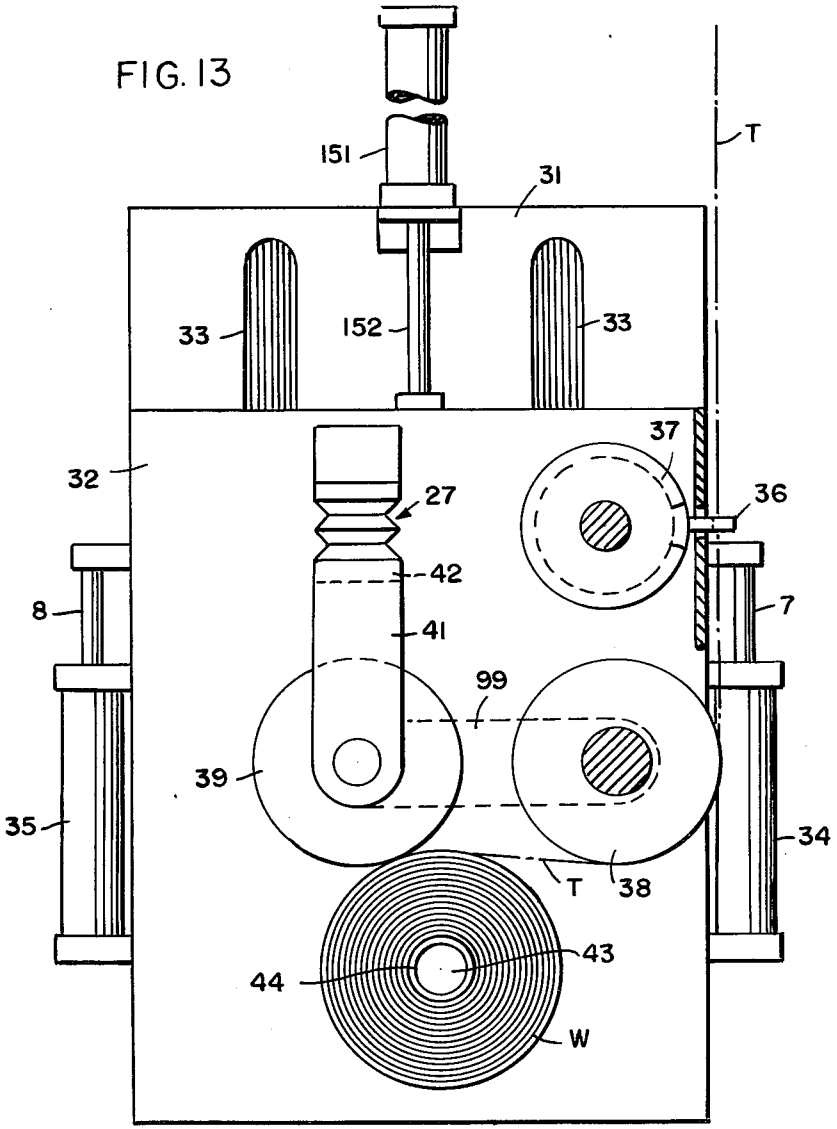
FIG. 13 is a sectional view on a vertical sectional plane just behind the outer wall of the carriage of a modification of the winding machine of FIG. 3.

FIG. 13 shows a machine similar to that illustrated in FIG. 3 but has a hydraulic cylinder 151 mounted on the frame 31 with its extensible piston rod 152 connected to the carriage 32. Otherwise the same reference numerals have been used as in FIG. 3. The operation of the hydraulic cylinder 151 and its control will now be described with reference to FIG. 13 and the schematic circuit diagram of FIG. 14.

The thread T is guided vertically downwards to the traversing device 36. The thread T is traversed by the grooved roller 38 as it is wound on winding W. The bobbin tube 44, as is true also in FIGS. 1 to 3, may be driven by a drive applied to chuck 43 so that the contact roller 39 has basically only a control function. However it is alternatively possible, as explained above, to drive the bobbin tube and its winding via the contact roller 39. The force storage units 27 are identical with those shown in FIGS. 3 and 4.

In contrast to the previously described embodiments, the weight of the carriage 32 is over compensated by the pneumatic cylinders 34 and 35, so that is no extra downward force were applied the carriage 32 would move into its uppermost position. To prevent such upward movement a downward force is generated in the hydraulic cylinder 151 in such a way that this downward force together with the force resulting from the weight of the carriage is equal in value to the force generated by the pneumatic cylinders 34 and 35. The contact roller 39 therefore contacts the bobbin surface with a pressure which is predetermined by the force storage unit 27. As a result there is an equilibrium of forces which enable the carriage 32 to be maintained in any position. The pressure in the pneumatic cylinders 34 and 35 is kept constant during the whole winding process.

To illustrate the operation of this embodiment, when a fully wound bobbin has just been replaced on the chuck shaft 43 by an empty bobbin tube 44, the carriage 32 is in its uppermost position. The valve W5 (FIG. 14) is switched into position "2". This can, for example, be effected by hand or in the case of automatic bobbin changing by sensing devices (not shown) or by a time relay which is triggered off by the carriage or by a full bobbin at any predetermined time. Movement of the valve W5 into position "2" causes the carriage to move downwards. Simultaneously with the movement of the valve W5 into position "2" a valve Db4 is opened. The valve Db4 is controlled by the pressure in the pipe 155 which is originated when the valve W5 is switched into position "2". As a result the hydraulic cylinder 151 is placed in communication with an oil reservoir 153. As a result of the downwards movement of the piston 154 in the hydraulic cylinder, it sucks oil from the storage container via the valve D*b*4 into its cylinder chamber. In its lowest position the carriage 32 operates a sensing element (not shown) which switches the valve W5 into position "1". As a result the valve D*b*4 is simultaneously blocked and the outflow out of the hydraulic cylinder 151 is regulated by a valve 155 which is activated mechanically by the support device for the contact roller 39. With the valve W5 in position "1", the two cylinders 34 and 35 are supplied with compressed air. However the carriage 32 remains stationary because the return from the hydraulic cylinder 151 through the valve 155 is closed by the support device 41, 42. The lowest position of the carriage is defined so that the contact roller 39 can apply the required pressure to the package or the bobbin tube, the support device being in the initial working position. The bobbin diameter increases during the winding process and as a result the support device is deflected upwards out of its initial working position by the contact roller 39. In this process the pressure does not change because the force generated by the force storage units 27 is independent of distance. The valve 155 is opened by the upward deflection of the support device whereby the return flow path from the hydraulic cylinder 151 is opened and the carriage 32 moves upwards. The support device is brought back into its working position, the valve 155 closes and the carriage 32 comes to a standstill. This sequence takes place according to the control distance adjusted for the support device and the bobbin diameter present at each moment, in a more or less continuous fashion.

When the bobbin is fully wound, the valve Db3 is opened by the bobbin or by the carriage position (broken line) as a result of which the return flow path of the oil from the hydraulic cylinder 151 to the reservoir 153 is opened. Since the full pump pressure is always present at the pneumatic cylinders 34 and 35, the carriage 2 moves into its uppermost position. In the uppermost position, the valve W5 is switched into the "0" position and for example the time relay for the control of the downward movement is tripped. At the same time as the valve W5 is switched, the valve D*b*3 is closed. The full bobbin can be removed from the chuck shaft and exchanged for an empty bobbin tube. The above described work operation cycle then begins again.

The invention is hereby claimed as follows:

1. A winding machine for winding synthetic threads on a winding tube to form a winding package comprising a rotatable chuck for holding said winding tube in winding position, thread traversing means for traversing the thread being wound on said package, a contact roller maintained in frictional contact with said winding tube and the winding thereon, said contact roller being mounted by a roller support member in a carriage, means mounting said carriage on the winding machine for vertical linear movement of said carriage and the contact roller, and means for maintaining substantially constant pressure between said contact roller and said winding, said means embodying pneumatic cylinder-piston means in a pneumatic control system for supporting the vertically movable carriage, pneumatic control means in said pneumatic system for retracting said carriage and said contact roller upwardly away from said winding as its diameter increases, and force storage means mounting said roller support member in said carriage for relative vertical movement of said member and said contact roller relative to said carriage, said force storage means embodying a body mounted on said carriage above said roller support member, said body having fluid-tight chamber means pressurized with air and having a flexible, vertically movable, membrane wall, and connecting means rigidly joining said vertically movable membrane wall and said roller support member, the air pressure in said chamber being such that most of the weight of the support member and the contact roller is borne by the air-pressure-supported membrane wall and a desired contact pressure is provided between the contact roller and the winding formed on the winding tube, whereby, as the diameter of the winding progressively increases, said air-pressure-supported membrane wall is moved upwardly from its normal position until the carriage begins to move upwardly in response to activation of said pneumatic control means, whereupon said membrane wall begins to move downwardly under the weight of the roller support member and the contact roller mounted thereon toward the normal position of the membrane wall.

2. A winding machine as claimed in claim 1, wherein said thread traversing means includes a roller with spiral grooves in its cylindrical surface for traversing the thread running across said roller in said spiral grooves, and means supporting said spirally grooved roller on said support member.

3. A winding machine as claimed in claim 1, wherein said chamber contains hydraulic fluid immersing damping means to damp vibrations of said contact roller.

4. A winding machine as claimed in claim 1, wherein said body comprises a cylinder with flexible membrane end walls forming a pressure tight chamber.

5. A winding machine as claimed in claim 1, wherein said force storage means comprises a cylindrical body with an axial bore, an annular wall on respective end faces of said cylindrical body, one annular wall having an inner diameter greater than that of the other annular wall whereby respective annular walls and end faces form annular chambers of different diameters, a flexible membrane being mounted on each annular wall and covering a respective chamber and functioning as a movable wall of said chamber, a cylindrical member extending through said bore from membrane to membrane and having a diameter smaller than the diameter of the bore, and a plate laid across the outer sides of respective membranes, each plate being smaller in area and being geometrically similar to its contiguous membrane's area functioning as said flexible wall, and means rigidly connecting the respective plates to opposite ends of said cylindrical member.

6. A winding machine as claimed in claim 5, wherein the cylindrical body has a vertical axis, the larger annular chamber being the upper chamber and the smaller annular chamber being the lower chamber, the lower chamber and a portion of the annular gap between said bore and said cylindrical member being filled with oil, and throttle means restricting flow of oil in the oil filled section.

7. A winding machine for winding synthetic threads on a winding tube to form a winding package comprising a rotatable chuck for holding said winding tube in winding position, thread traversing means for tranversing the thread being wound on said package, a contact roller maintained in frictional contact with said winding tube and the winding thereon, said contact roller being mounted by a roller support member in a carriage, means mounting said carriage on the winding machine for vertical linear movement of said carriage and the contact roller, and means for maintaining substantially constant pressure between said contact roller and said winding, said means embodying pneumatic cylinder-piston means in a pneumatic control system for supporting the vertically movable carriage, pneumatic control means in said pneumatic system for retracting said carriage and said contact roller upwardly away from said winding as its diameter increases, means mounting said roller support member in said carriage for relative vertical movement of said member and said contact roller relative to said carriage for maintaining a constant distance between the axis of said contact roller and the surface of said winding as said carriage and roller retract from said winding, means for supplying synthetic threads to the winding machine in a vertically downward direction, said thread traversing means embodying a horizontally reciprocating thread guide for traversing the downwardly running thread and a thread traversing roller having spiral grooves for traversing the thread running from said reciprocating thread guide to the winding package, a bobbin revolver below the carriage and rotatable about a horizontal axis, at least two bobbin tube chucks rotatably mounted on the bobbin revolver with respective horizontal axis of rotation, said chucks with winding tubes mounted thereon being orbitable by said bobbin revolver into frictional contact with said contact roller, means for transferring the running thread from a full bobbin on one chuck to an empty winding tube on another chuck, two oppositely acting nozzles positioned on opposite sides of a member forming impingement surfaces for air emitted from said nozzles, means for supplying said nozzles with compressed air, and compressed air conduit means connecting said nozzles and the cylinders of said cylinder and piston members for activating the pistons of said members in response to changing resistance to exit of air from the respective nozzles as said impingement surfaces move with the roller support member as the diameter of the winding on the winding tube increased and the carriage is moved upwardly by said cylinder and piston units to restore a predetermined control value maintained by the respective distances of the two nozzles from their respective impingement surfaces.

8. A winding machine as claimed in claim 7, wherein each of said nozzles is connected by a compressed air pipe to a compressed air source, and a variable air flow throttle mounted in each of said pipes for providing said predetermined control value.

9. A winding machine as claimed in claim 7, a first spacer disc mounted coaxially with the spirally grooved traversing roller, additional spacer discs mounted coaxially with each respective chuck, said spacer discs lying in a common vertical plane whereby, during the bobbin changing step by revolving the bobbin revolver, the distance between the empty tube surface and said spirally grooved traversing roller surface is kept constant.

10. A winding machine as claimed in claim 9, said spacer discs being electrically conductive, and electrical circuit means operatively associated with said discs, and a pnuematic control circuit in turn operatively connected with said piston cylinder members for monitoring the movement of the carriage during the bobbin changing step and the beginning of the new winding on the empty tube.

11. A winding machine as claimed in claim 7, wherein each of said nozzles is connected by a compressed air pipe to a compressed air source, and a variable air flow throttle mounted in each of said pipes for providing said predetermined control value, and means operatively associated with the throttle which provides the actual value for controlling such actual value by time or distance control means operable as a function of the carriage position.

12. A winding machine as claimed in claim 7, and means for mounting said nozzles for axially adjustable positioning relative to the impingement surface for adjusting the actual value.

13. A winding machine as claimed in claim 7, said means mounting said roller support member in said carriage for relative vertical movement of said member and said contact roller relative to said carriage including force storage means embodying a body mounted on said carriage above said roller support member, said body having fluid-tight chamber means pressurized with air and having a flexible, vertically movable, membrane wall, and connecting means rigidly joining said vertically movable membrane wall and said roller support member, the air pressure in said chamber being such that most of the weight of the support member and the contact roller is borne by the air-pressure-supported membrane wall and a desired contact pressure is provided between the contact roller and the winding formed on the winding tube, whereby, as the diameter of the winding progressively increases, said air-pressure-supported membrane wall is moved upwardly from its normal position until the carriage begins to move upwardly in response to activation of said pneumatic control means, whereupon said membrane wall begins to move downwardly under the weight of the roller support member and the contact roller mounted thereon toward the normal position of the membrane wall.

14. A winding machine for winding synthetic threads on a winding tube to form a winding package comprising a rotatable chuck for holding said winding tube in winding position, thread traversing means for traversing the thread being wound on said package, a contact roller maintained in frictional contact with said winding tube and the winding thereon, said contact roller being mounted by a roller support member in a carriage, means mounting said carriage on the winding machine for vertical linear movement of said carriage and the contact roller, and means for maintaining substantially constant pressure between said contact roller and said winding, said means embodying pneumatic cylinder-piston means in a pneumatic control system for supporting the vertically movable carriage, pneumatic control means in said pneumatic system for retracting said carriage and said contact roller upwardly away from said winding as its diameter increases, means mounting said roller support member in said carriage for relative vertical movement of said member and said contact roller relative to said carriage for maintaining a constant distance between the axis of said contact roller and the surface of said winding as said carriage and roller retract from said winding, a hydraulic cylinder and piston unit connecting said carriage and the machine frame to impart downward resistance to upward movement of the carriage by said cylinder piston means, and hydraulic conduit means operatively connected to the hydraulic cylinder and further embodying a control circuit for control of outflow of hydraulic fluid from said cylinder.

15. A winding machine as claimed in claim 14, said means mounting said roller support member in said carriage for relative vertical movement of said member and said contact roller relative to said carriage including force storage means embodying a body mounted on said carriage above said roller support member, said body having fluid-tight chamber means pressurized with air and having a flexible, vertically movable, membrane wall, and connecting means rigidly joining said vertically movable membrane wall and said roller support member, the air pressure in said chamber being such that most of the weight of the support member and the contact roller is borne by the air-pressure-supported membrane wall and a desired contact pressure is provided between the contact roller and the winding formed on the winding tube, whereby, as the diameter of the winding progressively increases, said air-pressure-supported membrane wall is moved upwardly from its normal position until the carriage begins to move upwardly in response to activation of said pneumatic control means, whereupon said membrane wall begins to move downwardly under the weight of the roller support member and the contact roller mounted thereon toward the normal position of the membrane wall.

16. A winding machine for winding synthetic threads on a winding tube to form a winding package comprising a rotatable chuck for holding said winding tube in winding position, thread traversing means for traversing the thread being wound on said package, a contact roller maintained in frictional contact with said winding tube and the winding thereon, said chuck being mounted by a support member in a horizontally movable carriage, means for supplying synthetic threads to the winding machine in a horizontal direction, said thread traversing means embodying a horizontally reciprocating thread guide for traversing the horizontally running thread and a thread traversing roller having spiral grooves for traversing the thread running from the reciprocating thread guide to the winding package, the thread running over said thread traversing roller in a contact arc therewith of at least 60°, pneumatic cylinder-piston means being mounted on the winding machine for moving said carriage horizontally, said contact roller being mounted on the machine frame for rotation about a fixed axis and being positioned relative to said chuck and the winding tube and winding mounted thereon and also relative to said thread traversing roller whereby the point of contact of the thread running onto the winding package precedes the point of contact of the contact roller with the winding package, said machine further having a pneumatic control circuit for controlling the actual value of pressure of the winding package against said contact roller, means mounting said chuck on said carriage and including frictionlessly operating force storage means, said control circuit embodying two oppositely acting pneumatic nozzles supplied with compressed air from a common compressed air source, impingement surface-forming means between the two nozzles and mounted on the horizontally movable support for the chuck, means in said control circuit responsive to change of respective distances between the nozzles and the impingement surfaces of said impingement surface-forming means for supplying compressed air to said cylinder and piston units, and a variable air flow throttle in the common air feed conduit for the respective nozzles.

17. A winding machine as claimed in claim 16, wherein said frictionless operating force storage means embodies damping means to damp vibrations of said contact roller.

18. A winding machine as claimed in claim 16, wherein said frictionless force storage means comprises a cylinder with flexible membrane end walls forming a pressure tight chamber containing a fluid under pressure.

19. A winding machine as claimed in claim 16, wherein said frictionless operating force storage means comprises a cylindrical body with an axial bore, an annular wall on respective end faces of said cylindrical body, one annular wall having an inner diameter greater than that of the other annular wall whereby respective annular walls and end faces form annular chambers of different diameters, a flexible membrane being mounted on each annular wall and covering a respective chamber and functioning as a movable wall of said chamber, a cylindrical member extending through said bore from membrane to membrane and having a diameter smaller than the diameter of the bore, and a plate laid across the outer sides of respective membranes, each plate being smaller in area and being geometrically similar to its contiguous membrane's area functioning as said flexible wall, and means rigidly connecting the respective plates to opposite ends of said cylindrical member.

* * * * *